United States Patent [19]

Kim

[11] Patent Number: 4,905,827

[45] Date of Patent: Mar. 6, 1990

[54] RIGID GOLF BAG WITH RIGID HINGED COVER

[76] Inventor: Young S. Kim, 22573 Woodridge Ct., Cupertino, Calif. 95014

[21] Appl. No.: 267,793

[22] Filed: Nov. 7, 1988

[51] Int. Cl.[4] ..... A63B 55/00; A63B 55/02

[52] U.S. Cl. ..... 206/315.3; 206/315.4; 206/315.5; 206/315.6; 280/DIG. 6

[58] Field of Search ..... 206/315.2, 315.3, 315.4, 206/315.6, 315.5, 315.7, 315.8; 280/DIG. 6; D3/37, 76; D34/15; 150/159, 160

[56] References Cited

U.S. PATENT DOCUMENTS

| | | | |
|---|---|---|---|
| 1,637,538 | 8/1927 | Sampson | 206/315.2 |
| 2,590,178 | 3/1952 | Jamison | 280/DIG. 6 X |
| 2,866,490 | 12/1958 | Thompson | 206/315.4 |
| 2,879,819 | 3/1959 | Turnbull | 206/315.4 |
| 3,460,597 | 8/1969 | Daly | 206/315.4 |
| 3,746,204 | 7/1973 | Nagai | 220/469 X |
| 3,941,398 | 3/1976 | Nelson | 206/315.4 X |
| 3,953,045 | 4/1976 | Feret, Jr. | 206/315.6 X |
| 4,012,051 | 3/1977 | Embinder | 206/315.4 X |
| 4,078,594 | 3/1978 | Oeckl | 206/315.4 |
| 4,319,616 | 3/1982 | Light | 206/315.6 X |
| 4,340,102 | 7/1982 | Isabel | 206/315.6 |
| 4,375,847 | 3/1983 | Picco | 206/315.2 |
| 4,383,563 | 5/1983 | Kirchhoff, Jr. | 206/315.2 |
| 4,442,937 | 4/1984 | Delauder | 206/315.4 |
| 4,522,299 | 6/1985 | Clark et al. | 206/315.3 |
| 4,538,728 | 9/1985 | Lewis | 206/315.3 |
| 4,657,135 | 4/1987 | Kjose | 206/315.6 |
| 4,699,164 | 10/1987 | Pilney et al. | 206/315.4 X |
| 4,767,001 | 8/1988 | Kim | 206/315.3 |
| 4,779,725 | 10/1988 | Gerber | 206/315.3 |
| 4,796,789 | 1/1989 | Willcocks | 206/315.2 X |

*Primary Examiner*—Sue A. Weaver

*Attorney, Agent, or Firm*—Flehr, Hohbach, Test, Albritton & Herbert

[57] ABSTRACT

A golf bag (10), generally rectangular in shape, has a rigid lower portion (18) having an open collar (42), fixably attached to the top of lower portion (18) and a closed, integral bottom (14). The bag (10) also has a rigid upper portion (16) comprising first and second halves (60 and 62), releasably hinges (70 and 72) for hingably connecting each of the halves to the collar at their opposing sides. The halves (60 and 62) are movable between an open position adjacent the lower portion of bag (10) and a closed position above the lower portion. A latch (74) for latching the halves together in the closed position is provided. The rigid lower portion (18) has a vertically extending lower compartment (28), integral with the lower portion and having a compartment door (30) formed from the lower portion with a pair of vertically extending hinges (32, 34) along one side and a latch (36) on the opposite sides.

20 Claims, 5 Drawing Sheets

RIGID GOLF BAG WITH RIGID HINGED COVER

BACKGROUND OF THE INVENTION

1. Field of the Invention

This invention relates to an improved form of a protective golf bag that prevents damage to golf clubs and other equipment carried in the bag during travel to and from the golf course. This invention also relates to an improved golf bag that efficiently organizes golf equipment for transport.

2. Description of the Prior Art

A variety of modifications have been proposed to conventional golf bags to provide increased protection to the golf clubs and make the bag more useful. For example, my original U.S. Pat. No. 4,767,001 discloses a rigid golf bag having an upper portion with vertically hinged upper halves that latch and unlatch to protect the club heads and U.S. Pat. No. 4,522,299 discloses a rigid golf bag having a releasable rigid cover that encloses the golf club heads during transport.

Other examples of modifications to conventional golf bags are disclosed in the following: U.S. Pat. Nos. 1,924,183; 2,590,178; 2,760,782; 2,837,346; 3,165,330; 3,172,681; 3,471,162; 3,738,677; 3,746,204; 3,941,398; 4,012,051; 4,017,091; 4,053,169; 4,078,594; 4,319,616; 4,340,102; 4,383,563, 4,442,937; 4,538,728; Des. 177,799; Des. 272,285; Des. 273,905; Canadian Pat. No. 671,291 and U.K. patent application No. 2,134,797 published Aug. 22, 1984.

Although a large number of such modifications to conventional golf bags have been disclosed in the prior art, a need still remains for a golf bag that will provide adequate protection for golf clubs during transport and is capable of carrying all of the articles a golfer will typically need for a round of golf. While my initial patent went a long way in fulfilling this need, the present invention provides a marked improvement over that disclosure as well as the examples of others set forth above.

SUMMARY OF THE INVENTION

Accordingly, it is an object of this invention to provide a novel golf bag that will enable golf clubs to be transported easily and safely, will protect golf clubs from damage during transport, and will carry all of the articles a golfer will typically need to play a round of golf in a size comparable to a conventional golf bag.

It is another object of the invention to provide such a golf bag, fabricated from a minimum number of parts.

It is yet another object of the invention to provide a golf bag that will keep the golf clubs and other objects stored therein safe, both during transport of the bag to and from the course, and while at the course or in the clubhouse.

It is a further object of the invention to provide such a golf bag that has a construction that permits the parts of the bag to be provided in a stylish design.

The attainment of these and other objects may be achieved through use of the novel golf bag herein disclosed. The golf bag in accordance with the invention has a rigid lower portion having an open collar fixably attached to the top of the lower portion and a closed, integral bottom. The rigid upper portion includes first and second halves and a releasable hinge arrangement for hingably connecting each of the halves to the collar at their opposing sides, the halves being movable between an open position adjacent the lower portion of the golf bag and a closed position directly above the lower portion.

The hinge arrangement comprises a pair of oppositely positioned hinges, one hinge being disposed between the first half of the upper portion and the collar and the other hinge being disposed between the second half of the upper portion and the collar, each hinge being formed of two interconnecting portions, separable along the interconnection, one portion of the hinge being integral with the collar and the other portion of the hinge being integral with the first or the second half of the upper portion. The two interconnected hinge portions have a detent between them, allowing them to be separated. In one form, the hinge portion integral with the first or the second half of the upper portion is formed with the detent for releasing the hinge portion integral with the first or second half from the hinge portion integral with the collar.

Also included is a latching mechanism on at least one side of the first and second halves disposed between the hinge arrangement for latching the halves together in the closed position.

The golf bag of the present invention further includes a mating shoulder and step between the bottom end of the upper portion and the top end of the lower portion, the mating shoulder and step attaching the rigid upper portion in place on the lower portion when the halves are positioned in the closed position and the latching mechanism is closed to fasten the opposite sides of the first and second halves together. In the preferred embodiment, the mating shoulder is on the first and second halves at the bottom end of the upper portion and the mating step is on the top end of the lower portion, integral with the collar.

The rigid lower portion of the golf bag of the present invention has a vertically extending lower compartment integral with the lower portion and having a compartment door formed from the lower portion with at least one vertically extending hinge along one side and latch mechanism on an opposite side.

The attainment of the foregoing and related objects, advantages and features of the invention should be more readily apparent to those skilled in the art, after review of the following more detailed description of the invention, considered along with the following drawings.

DETAILED DESCRIPTION OF THE INVENTION

Figure 1:
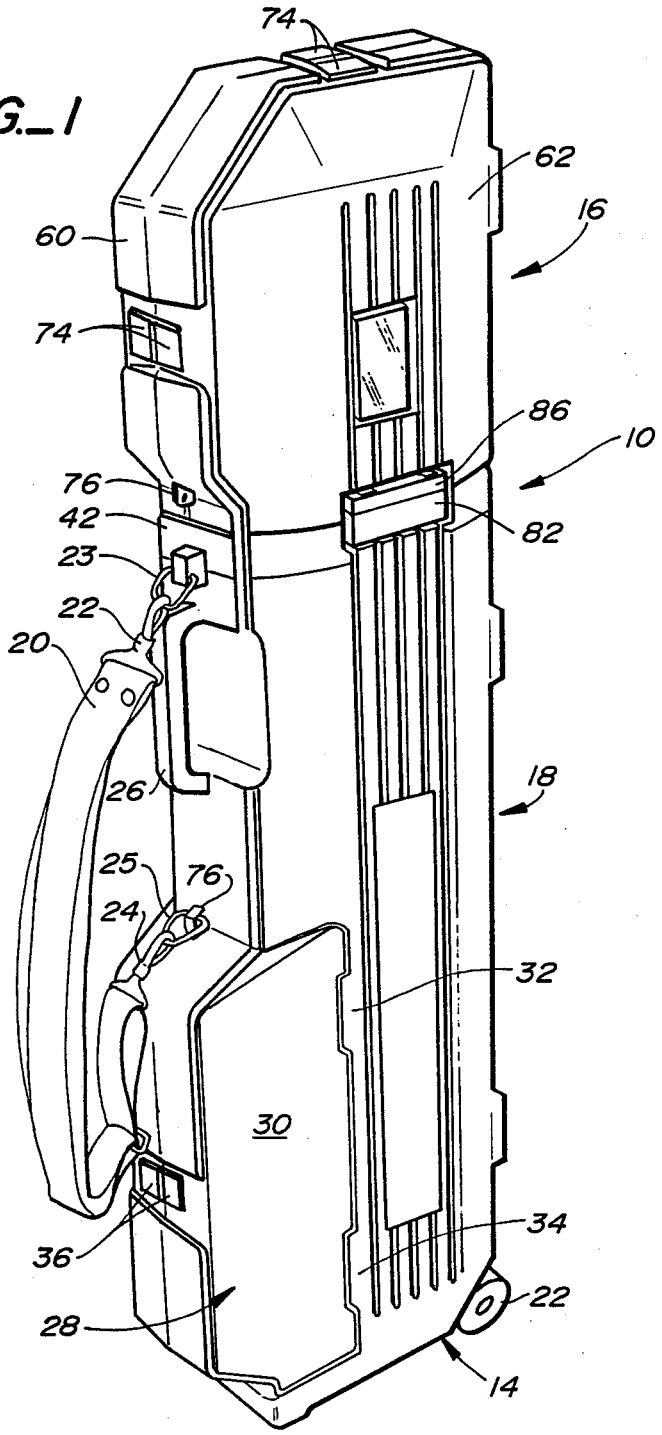
FIG. 1 is a perspective view of a golf club bag in accordance with the present invention.
Figure 2:
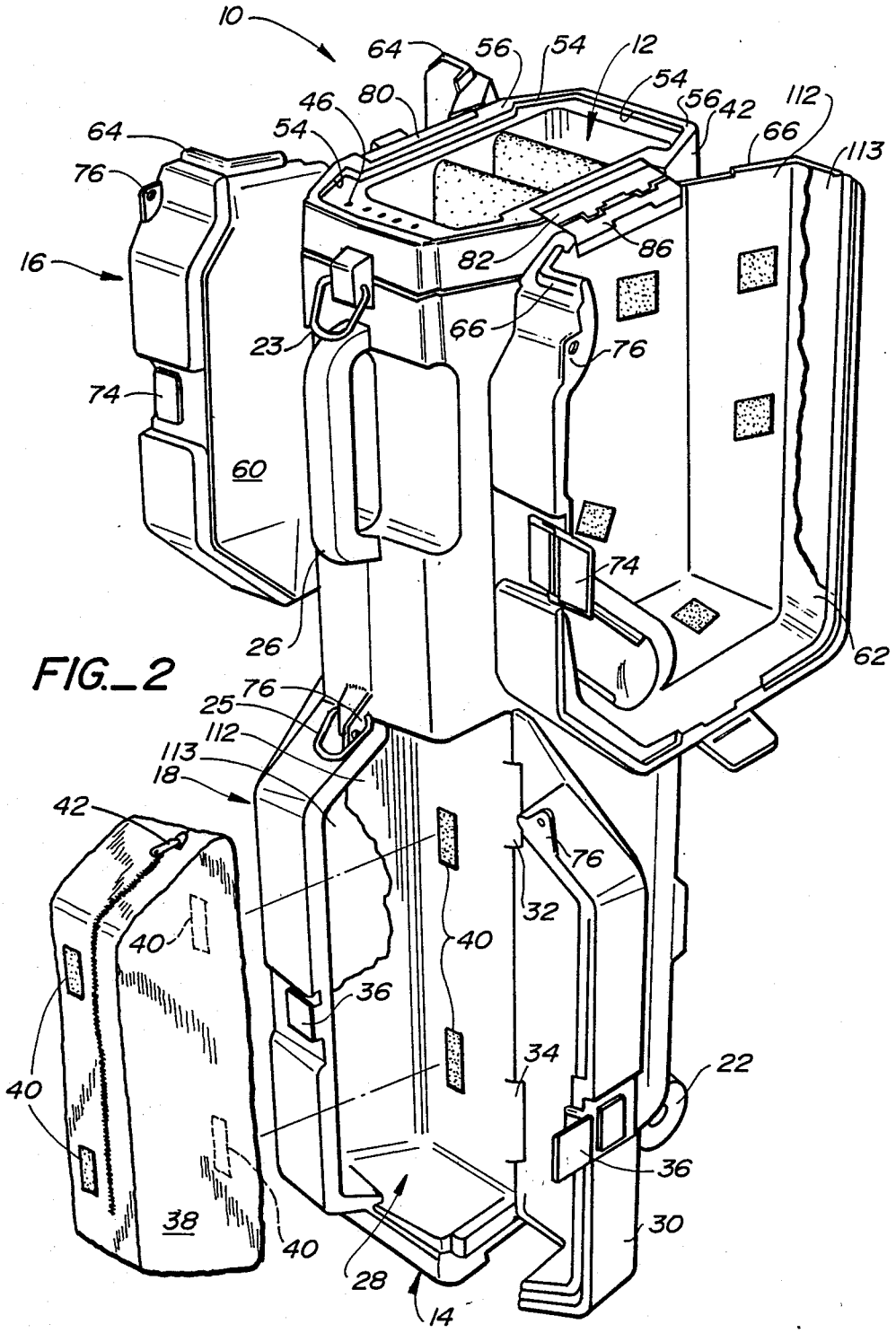
FIG. 2 is an identical view of FIG. 1, except that the compartments of the bag have been opened to disclose some of the novel features in the interior of the bag.

FIGS. 1 and 2 show a golf club bag according to the present invention and referred to by the general reference number 10. The bag is a generally rectangularly shaped container having an open top, 12, and an integral closed bottom, 14, an upper portion, 16, and a lower portion, 18. The upper portion 16 forms a removable cap or cover for the bag that fits over open top 12 in a manner that will be detailed below.

The bag has a removable shoulder strap, 20, and a pair of wheels, 22, so that it may be easily carried or pulled. Alternatively, one roller-like wheel may be provided. Shoulder strap 20 terminates at both ends into releasable hooks 22 and 24 that clamp on to rings 23 and 25 on the exterior of lower portion 18 of the bag in a manner already familiar to those skilled in the art.

Lower portion 18 has an integrally formed handle 26 disposed between open top 12 and integral bottom 14 and an integral, vertically extending, lower compartment, generally designated 28, in which to store, inter alia, golf shoes. Compartment 28 has a door, 30, which opens and closes by means of vertical hinges 32 and 34. Hinges 32 and 34 are formed integral with door 30 and lower portion 18, as best seen in FIG. 2. Compartment 28 is additionally formed with latch mechanism 36, positioned opposite hinges 32 and 34 so that door 30 may be latched closed.

Inside compartment 28 is removable shoe container or bag 38, which is formed to fit within the compartment, conforming substantially to the outlines thereof and removably affixed therein be means of mating VELCRO fasteners 40. As can be seen in FIG. 2, shoe bag 38 has on its exterior front and back portions two sets of VELCRO fasteners which mate with corresponding VELCRO fasteners in the interior of compartment 28. Bag 38 is also formed with a zipper, 42, to completely enclose golf shoes in the bag and maintain them in good condition during transport to and from the course.

Figure 6:
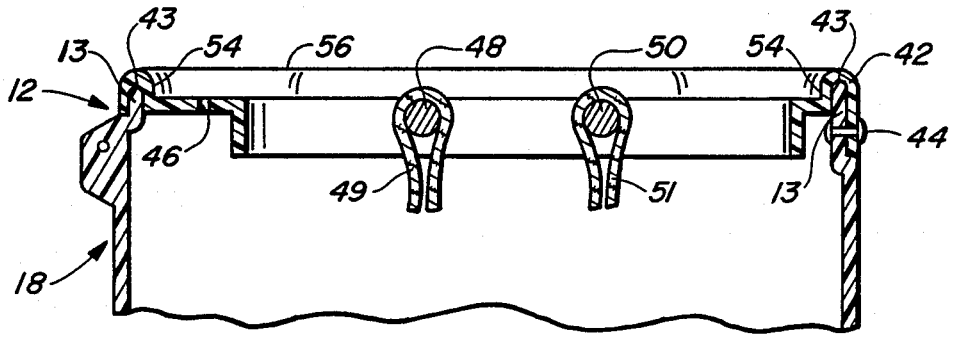
FIG. 6 is a cross sectional view of the bag, taken along the line 6—6 of FIG. 4.

Lower portion 18 is further provided with collar 42, which surrounds open top 12 circumferentially and is affixed thereto by means of rivet 44, as best seen in FIG. 6. Open top 12 is formed with a circumferential projection, 13, and collar 42 is formed with a mating, circumferential recess, 43, such that collar 42 can be snapped onto the end of lower portion 18 and permanently maintained in place by means of rivet 44.

Collar 42 is a one piece molded member, which is further formed with a plurality of spaced apart, vertically extending holes 46 at one side thereof for receiving and storing golf tees. Additionally, collar 42 has two dowels, 48 and 50 that traverse the opening in collar 42 and in lower portion 18 and function as dividers to provide three compartments, separate at their tops only, to separate, for example, woods from irons and both woods and irons from pitching and sand wedges, as well as the golfer's putter. Furthermore, dowels 48 and 50 are provided with protective pads 49 and 51 which fold over dowels 48 and 50 respectively and attach to themselves by means of VELCRO fasteners to provide maximum protection to the shafts of the golf clubs, which is especially desirable for graphite shaft clubs. Lastly, collar 42 is formed with a circumferentially extending step 54, which forms an upper ledge 56, circumscribing collar 42.

Figure 3:
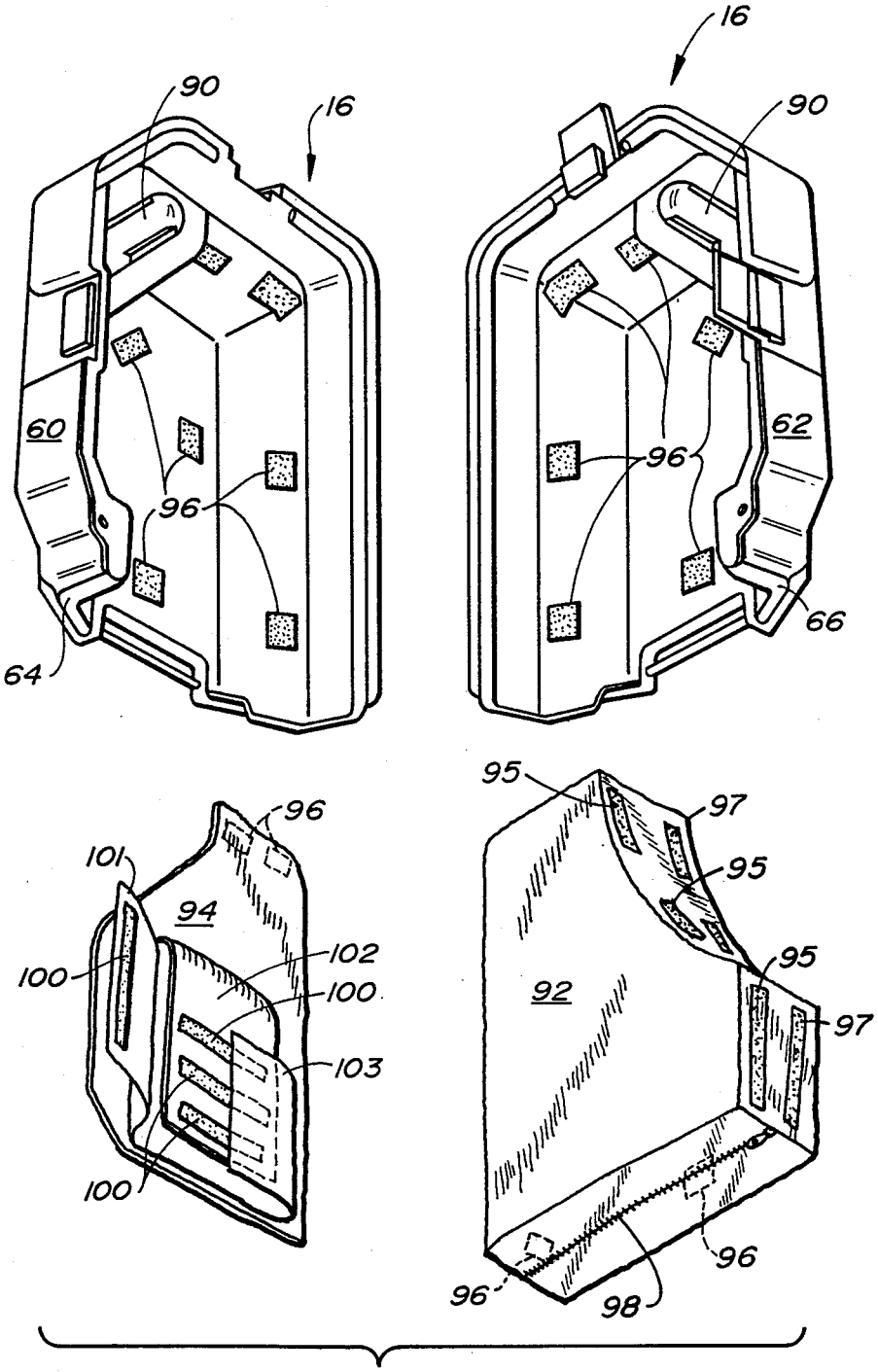
FIG. 3 is an exploded view of the top portion of the golf club bag of the present invention.
Figure 4:
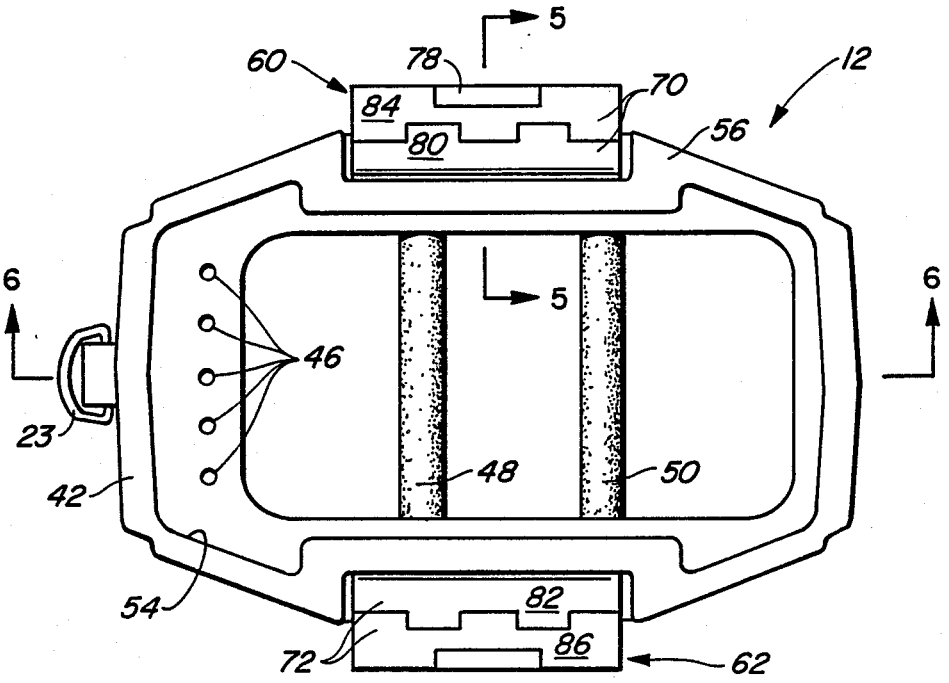
FIG. 4 is a top elevational view of the collar section of the bag.
Figure 5:
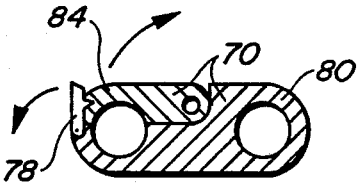
FIG. 5 is a cross sectional view of the bag, taken along the line 5—5 of FIG. 4, showing the operation of the hinged top portion of the bag.
Figure 5A:
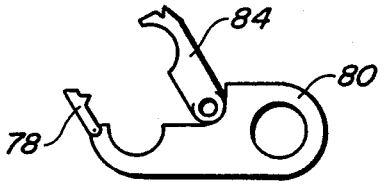
FIG. 5A is a cross section view corresponding to FIG. 5, but with part of the structure shown in a different position.

Referring now to FIGS. 3-5, upper portion 16 of the golf bag of the present invention will be described in detail. Upper portion 16 comprises two halves 60 and 62, each of which is formed at the bottom with a circumferentially extending, mating shoulder 64 and 66 respectively. These shoulders 64 and 66 mate with step 54 to attach upper portion 16 to lower portion 18 when halves 60 and 62 are in their closed position directly above lower portion 18.

Halves 60 and 62 are further provided with opposed hinges 70 and 72. Hinges 70 and 72 removably attach halves 60 and 62 to collar 42 and enable halves 60 and 62 to be rotated from a closed position directly above lower portion 18, as shown in FIG. 1 to an open position adjacent lower portion 18, as shown in FIG. 2. A pair of latches 74 are provided, one latch on the top of halves 60 and 62 opposite hinges 70 and 72 and another latch on the sides of halves 60 and 62, to fasten the halves together in the closed position. A lock receiving tab 76 formed of mating portions of halves 60 and 62, is also provided. An additional lock receiving tab, also designated 76, is likewise provided for the shoe compartment, 28, of the lower portion of the bag. This tab also carries ring 25 for shoulder strap 20 (see FIG. 2).

FIGS. 4 and 5 show details of the manner in which hinges 70 and 72 permit the removal of halves 60 and 62 from lower portion 18 of the golf bag of the present invention. As best seen in those figures, hinges 70 and 72 are formed from interconnecting portions of collar 42, specifically portions 80 and 82 respectively, and portions of the bottom of halves 60 and 62, specifically those portions designated 84 and 86 respectively in FIG. 4. Each interconnecting portion is integral with its respective collar or half and the hinges are separable along their respective interconnecting portions. That hinge portion integral with one or the other of the halves 60 and 62 of upper portion 16 is formed with a detent, 78, for releasing that hinge portion integral with that half from the hinge portion integral with the collar, as best seen in FIG. 5. In this manner both halves of the upper portion of the bag of the present invention may be removed. Such removal allows substantial weight reduction of the golf bag 10 while it is being used on the course.

Referring now to FIG. 3, additional features of the golf bag of the present invention will be discussed. First, each of the halves 60 and 62 of upper portion 16 is formed with an integral C-shaped slot, 90, for carrying golf balls. Additionally, each of the halves of the upper portion are formed with removable nylon fabric liners, 92 and 94. Fabric bag 92 is specially structured and arranged for protecting woods between it and head cover 94. Head cover 94 is specially structured and arranged for covering and protecting irons. When the halves 60 and 62 of upper portion 16 are closed, the heads of the woods are between fabric bag 92 and head cover 94 forming liners for the halves 60 and 62, thus protecting the clubs from jostling against each other and against the interior of the bag during transport. Because two fabric coverings are provided, one for woods and the other for irons, two layers of fabric protection for the clubs are provided when the upper portion of the bag is closed.

Each of the fabric bag 92 and cover 94 and each of the first and second halves 60 and 62 of the upper portion of the bag have a plurality of mating VELCRO fasteners 96 to maintain the covers in predetermined positions within the upper portion of the bag. Cover 94 is provided with a series of VELCRO fasteners 100 and three foldable flaps 101, 102 and 103, to enclose the heads of the irons for separating them from the woods and to provide expandability for extra irons. Fabric bag 92 is provided with a zipper, 98, to allow its use as a container for additional articles, particularly when half 62 of the bag upper portion is in its position as shown in FIG. 1. Mating VELCRO strips 95 and 97 are provided on the fabric bag 92 to aid in flattening it when it is used as a protective liner in the half 62 for the woods.

Figure 8:
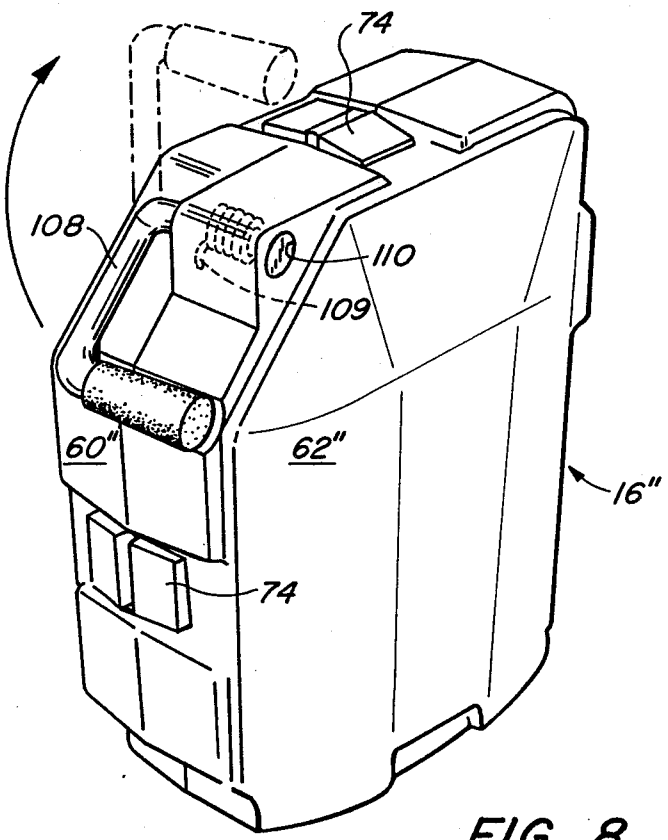
FIG. 8 is a perspective view of another alternate embodiment of the top portion of the golf bag of the present invention.
Figure 7:
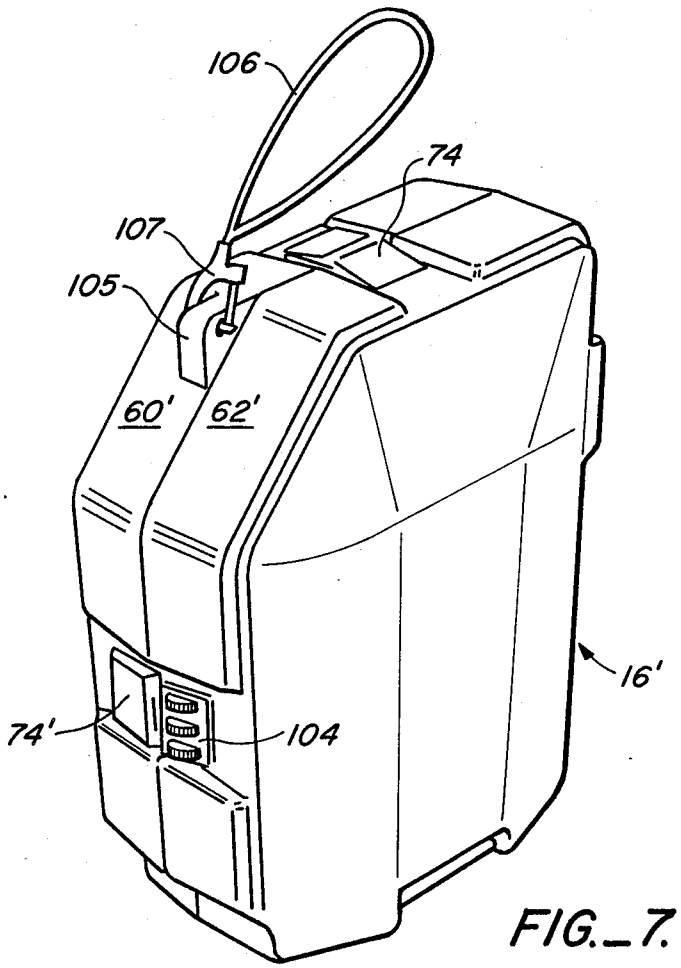
FIG. 7 is a perspective view of an alternate embodiment of the top portion of the golf bag of the present invention.

More features of the golf bag of the present invention are shown in FIGS. 7 and 8, which disclose different embodiments. As shown in FIG. 7, latch 74' of the upper portion of the bag may be provided with a combination lock, 104, so that the clubs may be secured safely in the bag during transport or shipment. (As an aside, an identical combination lock may be provided for latch 36 of the lower portion of the bag in the same manner as shown with respect to latch 74' for additional security purposes, although such arrangement is not shown in the figures.) Second, as shown in FIG. 7, one of the halves 60' or 62' (in this case half 60') of the upper portion is formed with a projecting dog 105 and a removable, clamp-on handle, the handle having a flexible cable portion 106 and a clamp portion 107 attached thereto.

As shown in FIG. 8, the golf bag of the present invention may alternatively be provided with a spring loaded handle, 108 rotatable between a stored position adjacent halves 60" and 62" and an operational position above the halves, as shown by the phantom line and arrow in that figure. Handle 108 is generally C-shaped and has a spring, 109, disposed about one end. Half 62" of the upper portion of the golf bag is formed with a spring end receiving and retaining bore, 110, which spring 109 and the spring retaining end of handle 108 are disposed within.

Finally, as shown by the cutaway portions in FIG. 2, the halves of the upper portion, as well as the lower portion are formed with double walls 112 and 113 for added rigidity and protection, as is described more fully in my above-referenced, issued patent. These, and the other major portions of the assembly are formed from a high density polyethylene for strength. The collar 42 is formed from a polyurethane to give a combination of softness and strength. The double walls 112 and 113 provide rigid protection for the golf clubs, while the softer collar 42, fabric liners 92 and 94 and protective pads 49 and 51 provide softness around portions of the clubs that would be subject to damage by hard surfaces.

It should now be apparent to those skilled in the art that a novel golf bag capable of achieving the stated objects of the invention has been provided. The golf bag of this invention will protect golf clubs while they are being transported and will hold all of the articles typically needed for a round of golf in a bag that is comparable in size to a conventional golf bag. The golf bag is fabricated from a minimum number of parts, and its construction allows for a stylish design.

It should further be apparent to those skilled in the art that various changes in form and details of the invention as shown and described may be made. It is intended that such changes be included within the spirit and scope of the claims appended hereto.

What is claimed is:

1. A golf bag comprising a rigid lower portion having an open collar fixably attached to the top end of said lower portion and a closed, integral bottom, a rigid upper portion comprising first and second halves, releasable hinge means connected between each of said halves and said collar at their opposing sides, said halves being movable between an open position each adjacent a side of said lower portion and a closed position directly above said lower portion, and latch means on at least one side of said first and second halves disposed between said hinge means for latching said halves together in said closed position, said hinge means comprising a pair of oppositely positioned hinges, one hinge being disposed between said first half of said upper portion and said collar and the other hinge being disposed between said second half of said upper portion and said collar, each hinge being formed of two interconnecting portions, separable along the interconnection, one portion of said hinges being integral with said collar and the other portion of said hinges being integral with said first and said second half of said upper portion.

2. The golf bag of claim 1 having a mating shoulder and step between the bottom end of said upper portion and the top end of said lower portion, said mating shoulder and step attaching said rigid upper portion in place on said lower portion when said halves are positioned in the closed position and said latching means are closed to fasten the opposite sides of said first and second halves together.

3. The bag of claim 2 in which said mating shoulder is on said first and second halves at the bottom end of said upper portion and said mating step is on the top end of said lower portion, integral with said collar.

4. The bag of claim 1 in which said hinge portion integral with said first or said second half of said upper portion is formed with a detent for releasing said hinge portion integral with said first or second half from said hinge portion integral with said collar.

5. The bag of claim 1 in which said first and second halves of said upper portion and said lower portion have double walls and are formed from a polyethylene.

6. The bag of claim 5 in which said polyethylene is a high density polyethylene.

7. The golf bag of claim 1 in which said lower portion is generally rectangular.

8. A golf bag comprising a rigid lower portion having an open collar, fixably attached to the top of said lower portion and a closed, integral bottom, a rigid upper portion comprising first and second halves, releasable hinge means for hingably connecting each of said halves to said collar at their opposing sides, said halves being movable between an open position adjacent said lower portion and a closed position above said lower portion, and latch means on at least one side of said first and second halves disposed between said hinge means for latching said halves together in said closed position, said rigid lower portion having a vertically extending lower compartment integral with said lower portion and having a compartment door formed from said lower portion with at least one vertically extending hinge along one side and latch means on an opposite side, said lower compartment being formed with a removable shoe bag, said shoe bag and said compartment having mating fasteners to maintain said bag in a predetermined position within said compartment.

9. The golf bag of claim 8, said collar having a plurality of vertically extending holes formed for receiving and holding golf tees.

10. The golf bag of claim 8, said lower portion having an integrally formed handle disposed above said compartment and below said collar.

11. The golf bag of claim 8, said latch means including a combination lock.

12. A golf bag comprising a rigid lower portion having an open collar, fixably attached to the top of said lower portion and a closed, integral bottom, a rigid upper portion comprising first and second halves, releasable hinge means for hingably connecting each of said halves to said collar at their opposing sides, said halves being movable between an open position adjacent said lower portion and a closed position above said lower portion, and latch means on at least one side of said first and second halves disposed between said hinge means for latching said halves together in said closed position, said rigid lower portion having a vertically extending lower compartment integral with said lower portion and having a compartment door formed from said lower portion with at least one vertically extending hinge along one side and latch means on an opposite side, at least one of said first or second halves of said upper portion being formed with an integral C-shaped slot for carrying golf balls.

13. A golf bag comprising a rigid lower portion having an open collar, fixably attached to the top of said lower portion and a closed, integral bottom, a rigid upper portion comprising first and second halves, releasable hinge means for hingably connecting each of said halves to said collar at their opposing sides, said halves being movable between an open position adjacent said lower portion and a closed position above said lower portion, and latch means on at least one side of said first and second halves disposed between said hinge means for latching said halves together in said closed position, said rigid lower portion having a vertically extending lower compartment integral with said lower portion and having a compartment door formed from said lower portion with at least one vertically extending hinge along one side and latch means on an opposite side, each of said first and second halves of said upper portion being formed with removable golf club head protective liners, one of said liners being structured and arranged for protecting woods and the other of said covers being structured and arranged for expandably covering and protecting irons, each of said liners and said first and second halves having mating fasteners to maintain said liners in predetermined positions within said upper portion of said bag.

14. The golf bag of claim 13, said collar including at least one dowel structured and arranged to divide said collar into at least two sections of substantially equal size, said at least one dowel being formed with protective padding to prevent damage to the shafts of the golf clubs.

15. A golf bag comprising a rigid lower portion having an open collar, fixably attached to the top of said lower portion and a closed, integral bottom, a rigid upper portion comprising first and second halves, releasable hinge means for hingably connecting each of said halves to said collar at their opposing sides, said halves being movable between an open position adjacent said lower portion and a closed position above said lower portion, and latch means on at least one side of said first and second halves disposed between said hinge means for latching said halves together in said closed position, said rigid lower portion having a vertically extending lower compartment integral with said lower portion and having a compartment door formed from said lower portion with at least one vertically extending hinge along one side and latch means on an opposite side, one of said first and second halves of said upper portion having a spring loaded handle, rotatable between a stored position adjacent said halves and an operational position above said halves, said handle being generally C-shaped and having a spring disposed about one end, said first or second half of said upper portion being formed with a spring end receiving and retaining bore.

16. A golf bag comprising a rigid lower portion having an open collar, fixably attached to the top of said lower portion and a closed, integral bottom, a rigid upper portion comprising first and second halves, releasable hinge means for hingably connecting each of said halves to said collar at their opposing sides, said halves being movable between an open position adjacent said lower portion and a closed position above said lower portion, and latch means on at least one side of said first and second halves disposed between said hinge means for latching said halves together in said closed position, said rigid lower portion having a vertically extending lower compartment integral with said lower portion and having a compartment door formed from said lower portion with at least one vertically extending hinge along one side and latch means on an opposite side, one of said first and second halves of said upper portion having a removable, clamp-on handle, said handle having a flexible cable portion and a clamp portion attached thereto.

17. A golf bag comprising a rigid lower portion having an open collar fixably attached to the top of said lower portion and a closed, integral bottom, a rigid upper portion comprising first and second halves, separable hinge means connected between at least one of said halves and said collar, said at least one of said halves being movable between an open position adjacent a side of said lower portion and a closed position directly above said lower portion, and latch means between said first and second halves for latching said halves together in said closed position, said hinge means comprising a hinge disposed between said at least one of said halves and said collar, said hinge being formed of two interconnected portions, separable along the interconnection, one portion of said hinge being integral with said collar and the other portion of said hinge being integral with said at least one of said halves.

18. The bag of claim 17, in which said hinge portion integral with said at least one of said halves of said upper portion is formed with a detent for releasing said hinge portion integral with said at least one of said halves from said hinge portion integral with said collar.

19. A golf bag comprising a rigid lower portion having an open collar fixably attached to the top of said lower portion and a closed, integral bottom, a rigid upper portion comprising first and second halves, separable hinge means connected between at least one of said halves and said collar, said at least one of said halves being movable between an open position adjacent a side of said lower portion and a closed position directly above said lower portion, and latch means between said first and second halves for latching said halves together in said closed position, each of said first and second halves of said upper portion being formed with removable golf club head protective liners, one of said liners being structured and arranged for protecting woods and the other of said covers being structured and arranged for expandably covering and protecting irons, each of said liners and said first and second halves having mating fasteners to maintain said liners in predetermined positions within said upper portion of said bag.

20. The golf bag of claim 19, said collar including at least one dowel structured and arranged to divide said collar into at least two sections of substantially equal size, said at least one dowel being formed with protective padding to prevent damage to the shafts of the golf clubs.

* * * * *